United States Patent [19]

Miyata

[11] Patent Number: 5,055,642

[45] Date of Patent: Oct. 8, 1991

[54] PUSH BUTTON SWITCH

[75] Inventor: Muneyoshi Miyata, Tokyo, Japan

[73] Assignee: Mitsuku Denshi Kogyo Kabushiki Kaisha, Tokyo, Japan

[21] Appl. No.: 569,712

[22] Filed: Aug. 20, 1990

Related U.S. Application Data

[62] Division of Ser. No. 368,809, Jun. 20, 1989.

[51] Int. Cl.[5] ..... H01H 13/70; H01H 9/02

[52] U.S. Cl. ..... 200/293; 200/343; 200/303; 200/406

[58] Field of Search ..... 200/293, 341, 302.2, 200/406, 303, 343

[56] References Cited

U.S. PATENT DOCUMENTS

| | | | |
|---|---|---|---|
| 3,587,944 | 6/1971 | Pehr | 220/256 |
| 3,597,564 | 8/1971 | Lewis | 200/303 |
| 3,867,591 | 2/1975 | Nordeen | 200/303 |
| 3,944,766 | 3/1976 | Wood | 200/243 |
| 4,200,781 | 4/1980 | Dummer | 200/303 |
| 4,484,042 | 11/1984 | Matsui | 200/406 |
| 4,766,272 | 8/1988 | Gozzon | 200/302.2 |
| 4,766,277 | 8/1988 | Bigelow, Jr. | 200/293 |
| 4,782,200 | 11/1988 | Oba | 200/303 |
| 4,843,197 | 6/1989 | Kojima et al. | 200/406 |
| 4,913,285 | 4/1990 | Tsutsumi et al. | 200/406 |
| 5,006,680 | 4/1991 | Thomas | 200/343 |

*Primary Examiner*—Henry J. Recla
*Assistant Examiner*—Keith Kupferschmid
*Attorney, Agent, or Firm*—Oblon, Spivak, McClelland, Maier & Neustadt

[57] ABSTRACT

A push button switch comprising a body, a cover, a push button and a diaphragm type movable contact. The casing body and cover (or the casing body, cover and push button, or the casing body and cover provided with a push button section) are concurrently formed by monolithic molding and are integrally connected to each other through a hinge section.

5 Claims, 7 Drawing Sheets

PUSH BUTTON SWITCH

This is a division of application Ser. No. 07/368,809, filed on June 20, 1989.

BACKGROUND OF THE INVENTION

1. Field of the Invention

The present invention relates to a push button switch. Typically, such a switch might include a small-sized casing which is square in plan and formed into, for example, a rectangular parallelpiped having dimensions of 6 mm in length, 6 mm in width and 4 mm in height. It would generally have a push button, a diaphragm type movable contact, fixed contacts, and terminals connected to a circuit for the fixed contacts, all arranged in the casing. When a push button projecting from the cover of the casing is pushed down, the movable contact is depressed to contact the fixed contacts to turn the switch on.

2. Description of the Prior Art

A conventional push button switch is shown in FIG. 8. It includes a casing 1 consisting of a small generally square body 1*a* made of an insulating plastic material, a lid or cover 1*b* made of a thin metal sheet, and also a push button 2, a diaphragm type movable contact 3, fixed contacts 4 and terminals 4*a* connected to a circuit of the fixed contacts 4 all arranged in the casing 1. The push button 2 is made of an insulating plastic material and is so arranged that the upper portion of a button section 2*a* of the push button 2 projects from the cover 1*b* through an aperture 5. The movable contact 3 includes a diaphragm made of a metal sheet, a conductive rubber material a conductive plastics material oz the like and a conductive section formed of a conductive coating material on the inner surface of the diaphragm to prove at least the inner surface with conductivity. The fixed contacts 4 and terminals 4*a* are formed by embedding a metal sheet in the casing body 1*a* by insert molding during forming of the casing body 1*a*. Alternatively, they may at least in part comprise a printed board.

The push button switch so constructed is used in electrical and electronic appliances such as video units, televisions and the like in numbers as high as tens of millions per month.

The manufacture of this conventional push button switch will now be described, assuming that the fixed contacts 4 and terminals 4*a* are formed by insert molding.

The casing body 1*a*, provided with the fixed contacts 4 and terminals 4*a*, and the push button 2 are respectively made by molding a plastic material. The cover 1*b* and diaphragm type movable contact 3 are made from a metal sheet by pressing. The movable contact 3 and push button 2 are then inserted into the casing body 1*a* and the cover 1*b* is integrally mounted on the casing body 1*a* by suitable means such as fitting, caulking or the like.

As will be understood from the foregoing, the conventional push button switch requires that the casing body 1*a* push button 2, cover 1*b* and the movable contact 3 are made separately from one another, so that manufacturing the push button switch tends to be highly complicated Also, the manufacture requires integration of the separately made components for assembling of the switch, resulting in further difficulties and complications.

Thus, the conventional push button switch requires four independent components, namely, the casing body 1*a* provided with the fixed contacts 4 and the terminals 4*a* in this case, the cover 1*b*, the push button 2, and the diaphragm type movable contact 3. The components are each required to be formed by molding or pressing. It will be appreciated that a decrease in the number of parts or a decrease in the number of molds and molding or pressing operations would be highly desirable because it would necessarily lead to an increase in the efficiency of the manufacturing process and a reduction in manufacturing costs.

The formation of a container and its cover according to conventional plastic molding techniques is generally carried out by integrally forming the container and cover together while interconnecting both through a thin-wall section between them, the thin-wall section providing a hinge in the finished product.

SUMMARY OF THE INVENTION

The present invention has been made in view of the foregoing disadvantage of the prior art.

Accordingly, it is an object of the present invention to provide a push button switch which is substantially simpler to manufacture.

According to the present invention, there is provided a push button switch comprising: a casing including a casing body and a cover; a push button; a diaphragm type movable contact and fixed contacts located in the casing; and terminals connected to a circuit for the fixed contacts; the casing body and cover being integrally connected to each other through a thin-wall hinge section by concurrently forming the casing body and cover from a plastics material by monolithic molding; the cover being moved pivotally about the hinge section and fixed onto the casing body.

Preferably, the casing body comprises a switch as claimed in claim 1, in which the casing body is formed in one mold section and the cover is formed in another mold section, the two sections being in communication with each other through adjacent edges of the two mold sections.

Preferably, the casing body comprises a push switch in which the casing body, cover and push button are integrally connected to each other through thin-wall hinge sections by concurrently forming the casing body, cover and push button from a plastic material by monolithic molding; the push button being moved pivotally about its hinge section, so that it is arranged in the casing body.

In a preferred form, therefore, the invention may provide a push button switch which includes: a casing comprising a casing body and a cover; a push button; a diaphragm type movable contact and fixed contacts arranged in the casing; and terminals connected to a circuit of the fixed contacts leading out from the casing, the casing body, cover and push button being integrally connected to each other through thin-wall hinge sections by concurrently forming the casing body, cover and push button from a plastic material by monolithic molding. The push button is pivotally movable about its hinge section so that it can be arranged in the casing body, and the cover is pivotally movable about its hinge section, so that it can be fixed on the casing body.

Preferably, a support section comprises a switch, further comprising a support section located between a button section of the push button and its hinge section for integrally connecting the casing body and the push button. Preferably, the casing body comprises a switch, in which the casing body, the cover and the push button are formed in separate mold sections which are in communication with each other through adjacent edges of the mold sections.

In an alternative form, the push-button comprises a switch, in which the push button comprises a push button section on the cover, the casing body and the cover provided with the push button section being integrally connected to each other through a thin-wall hinge section. The invention may therefore also provide a push button switch which includes: a casing body and a cover provided with a push button section; a diaphragm type movable contact and fixed contacts arranged in the casing; and terminals connected to a circuit of the fixed contacts leading out from the casing; the casing body and the cover provided with the push button section being integrally connected to each other through a thin-wall hinge section by concurrently forming the casing body and the cover provided with the push button section from a plastics material by monolithic molding. The cover is pivotally movable about the hinge section, so that it can be fixed on the casing body.

As can be seen, the present invention is so arranged that the casing body and cover, or the casing body, cover and push button, or the casing body and cover provided with the push button section, are integrally connected to each other through the hinge section(s). This permits two or more components of the push button switch to be concurrently formed by monolithic mold; they are therefore formed in a single molding operation.

The conventional push button switch requires the separate forming of four components, namely the casing body provided with the fixed contacts and terminals, the cover, the push button and the diaphragm type movable contact. Thus, manufacturing this conventional push button switch requires four molding or pressing dies and four molding or pressing operations, i.e. a mold for forming the casing body from a plastic material and the operation for forming it using the mold, a mold for forming the push button from the plastics material and the operation for forming it using the mold, a die for forming the cover from a metal sheet by pressing and an operation for forming it using the die, and a die for forming the diaphragm type movable contact from a metal sheet by pressing and an operation for forming it by means of the die.

In contrast, the present invention accomplishes a decrease in the number of parts to be formed and a decrease in both the number of molds and dies to be used, and also a decrease in the number of forming operations to be carried out. More particularly, the first embodiment of the present invention only requires a mold for concurrently forming the casing body and cover by monolithic from a plastic material and an associated operation; a mold for forming the push button by molding from a plastic material and an associated operation; and a die for forming the diaphragm type movable contact by pressing of a metal sheet and an associated operation.

In the second embodiment of the present invention, only a mold for concurrently forming the casing body, cover and push button by monolithic molding from a plastics material and an associated operation therefor, and a die for forming the diaphragm type movable contact by pressing a metal sheet and an associated operation are required.

Also, the third embodiment of the present invention merely requires a mold for concurrently forming the casing body and cover with push button section by monolithic molding from a plastic material and an associated operation and a die for forming the diaphragm type movable contact by pressing a metal sheet and an associated operation.

Thus, it will be noted that the present invention can accomplish manufacture of the push button switch with high efficiency and significantly reduced manufacturing costs.

Furthermore, assembly of the push button switch may be readily and rapidly carried out because it merely requires a pivotal movement to connect the cover to the casing body through the hinge section, or the cover and push button separately connected to the casing body through their hinge sections, or the cover provided with the push button section and connected to the casing body through the hinge section. The cover is then simply fixed to the casing body using some suitable means.

BRIEF DESCRIPTION OF THE DRAWINGS

These and other objects and many of the attendant advantages of the present invention will be readily appreciated at the same becomes better understood by reference to the following detailed description when considered in connection with the accompanying drawings in which like reference numerals designate like or corresponding parts throughout; wherein.

DESCRIPTION OF THE PREFERRED EMBODIMENTS

Figure 1:
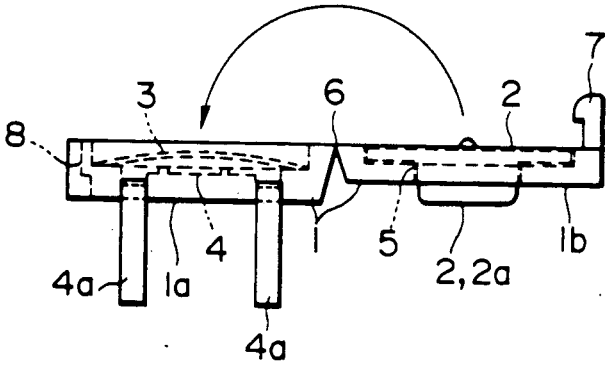
FIG. 1(A) is a front elevational view of a first embodiment of a push button switch according to the present invention, in which the switch is as molded and the cover is open.
FIG. 1(B) is a plan view of the push button switch shown in FIG. 1(A)
FIG. 1(C) is a front elevational view of the push button switch in which the cover is closed and the switch is in the form of a finished product.
FIG. 1(D) is a vertical sectional view of the push button switch shown in FIG. 1(C)
Figure 1:
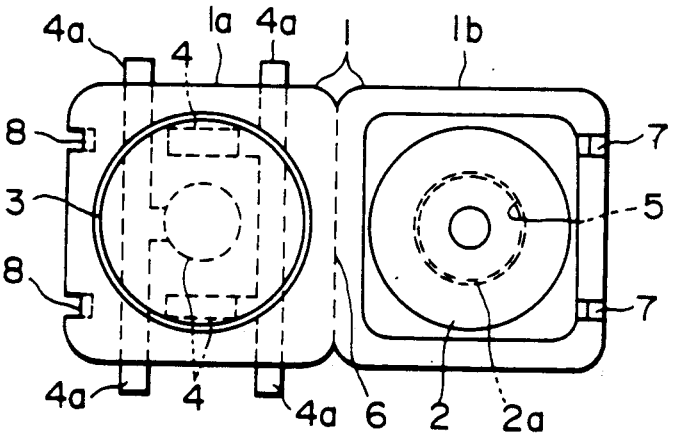
Figure 1:
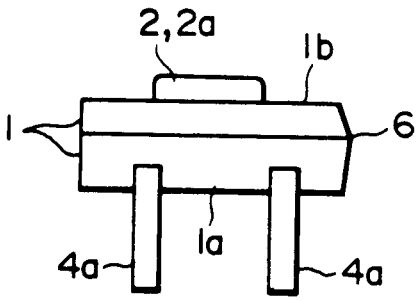
Figure 1:
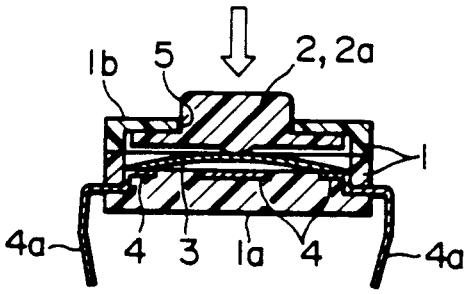
Figure 2:
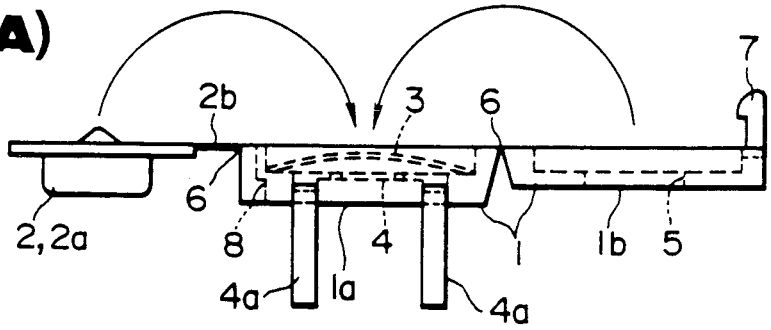
FIG. 2(A) is a view similar to FIG. 1(A) showing a second embodiment.
FIG. 2(B) is a plan view of the push button switch shown in FIG. 2(A)
FIG. 2(C) is a front elevational view of the push button switch shown in FIG. 2(A), in which the push button is within the casing body and the switch is in the form of a finished product.
FIG. 2(D) is a vertical sectional view of the push button switch shown in FIG. 2(C)
FIG. 2(E) is a fragmentary plan view showing a modification of a support section of the push button switch shown in FIG. 2(A)
Figure 2:
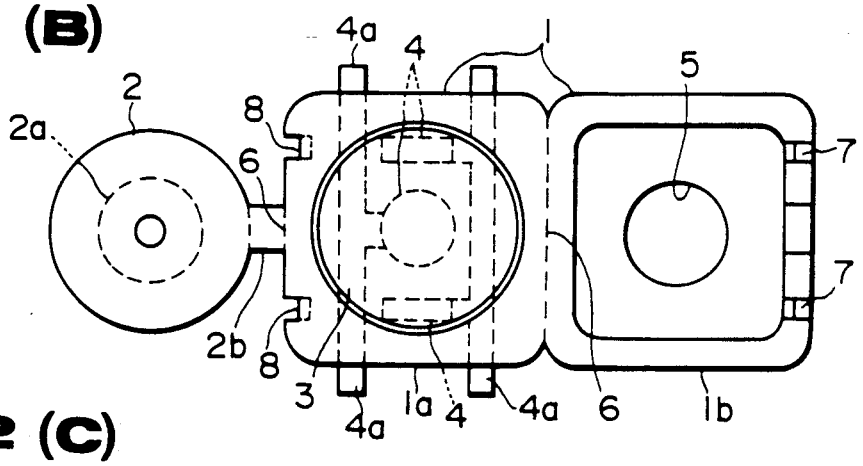
Figure 2:
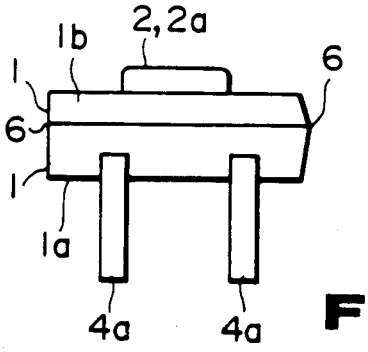
Figure 2:
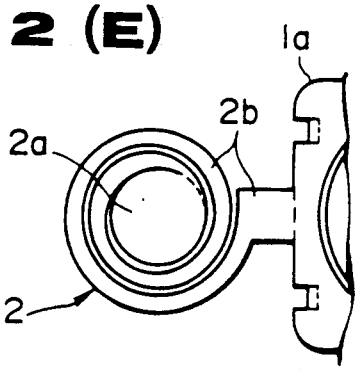
Figure 2:
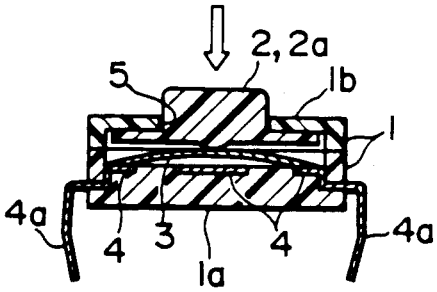

A push button switch according to the present invention will be described hereinafter with reference to the accompanying drawings.

FIGS. 1(A) to 1(D) show a first embodiment of a push button switch according to the present invention. The switch includes a casing 1 comprising a small-sized casing body 1*a*, substantially square when viewed from above and a cover 1*b*. The casing 1 can be formed into a rectangular parallelpiped having dimensions of, for example, 6 mm in width and 4 mm in height. The switch also includes a push button 2, a diaphragm type movable contact 3 and fixed contacts 4 which are arranged in the casing 1. Terminals 4*a*, which lead out from the casing 1 are connected to the fixed contacts 4.

The casing body 1*a* and cover 1*b* are concurrently or simultaneously formed together by integral or monolithic molding of a plastics material so that they are integrally connected to each other through a thin-wall hinge section 6 located between them and along their length. Subsequently, the diaphragm contact 3 and 2 are inserted into the casing body 1*a* and then the cover 1*b* is pivoted about the hinge section 6 towards the casing body 1*a* where it is fixedly mounted. This results in the formation of the push button switch of this embodiment.

The suitable means for fixing the cover 1*b* on the casing body 1*a* could consist of an adhesive, thermal fusion or the like. In the illustrated embodiment, the cover 1*b* is fixed to the casing body 1*a* by means of a mutual engagement structure. For this purpose, the casing body 1*a* and cover 1*b* are provided with projections 7 and respective recesses 8. The projections 7 and recesses 8 are adapted to engage when the cover 1*b* is pivoted about the hinge section 6 towards the casing body 1*a*, and so the cover 1*b* is fixed on the casing body 1*a*.

The fixed contacts 4 and terminals 4*a* are made from a metal sheet and embedded in the casing body 1*a* by insert molding.

The casing body 1*a* and cover 1*b* are concurrently formed by monolithic molding and are connected together through the hinge section 6. The mold structure used for this purpose may be in the form of a single mold including a mold section for forming the casing body 1*a* and a mold section for forming the cover 1*b* which communicate with a communication section between adjacent edges of the mold section. The thin-wall hinge section 6 is formed by the communication section.

A button section 2*a* of the push button 2 projects up from the cover 1*b* via a through-hole or opening 5.

FIGS. 2(A) to 2(E) shows a second embodiment of a push button switch according to the present invention. In this embodiment, the casing body 1*a*, the cover 1*b* and the push button 2 are concurrently formed from a plastic material by monolithic molding so that the lid 1*b* and push button 2 is positioned on either side of the casing body 1*a* and connected through thin-wall hinge sections 6. The diaphragm type movable contact 3 is located in and then the push button 2 is pivoted towards the casing body 1*a* about its binge section 6, until it fits on the casing body 1*a*. The cover 1*b* is then pivoted towards the casing body 1*a* about its hinge section 6 and is fixed to the casing body 1*a* by some suitable means, thus forming the push button switch.

Figure 3:
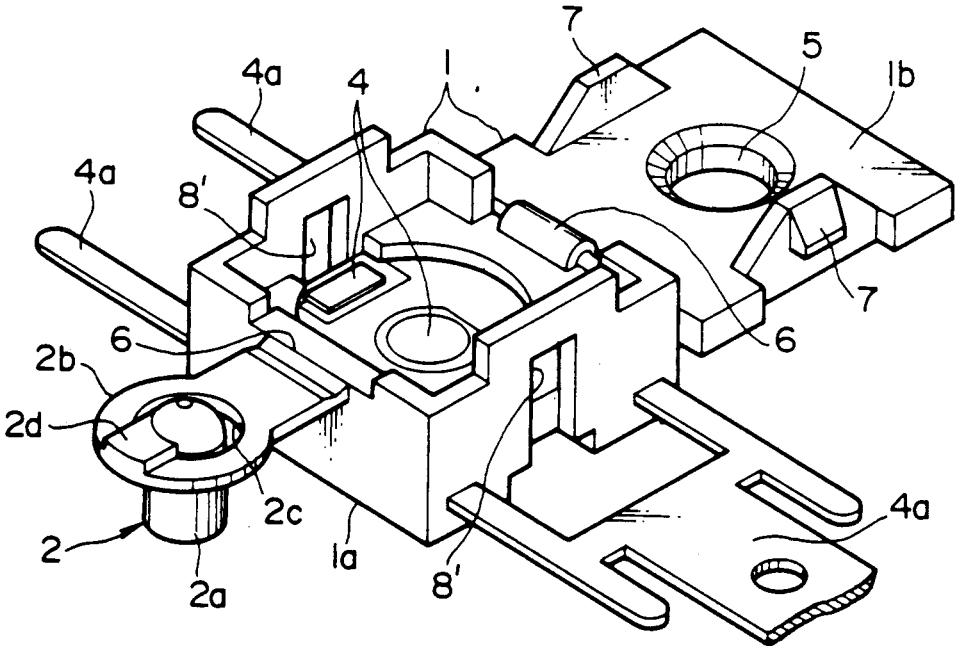
FIG. 3 is a perspective view showing a modification of the second embodiment shown in FIG. 2(A)

The means for fixing the cover 1*b* on to the casing body 1*a* may be similar to those described above in connection with the first embodiment. Alternatively, as shown in FIG. 3, there may be a combination of projections 7 provided on the cover 1*b* and apertures 8' correspondingly formed in the casing body 1*a* which engage one another.

In the illustrated embodiment, in order to ensure a simple and smooth operation or vertical movement of the button section 2*a* after assembling the switch, in spite of the fact that the button section 2*a* is formed integrally with the casing body 1*a*, a support section 2*b* is formed between the button section 2*a* and the hinge section 6 for interconnecting the casing body 1*a* and the push button 2. The support section 2*b* may take any suitable shape such as a thin-wall disc like shape, a spiral spring like shape, or the like.

The button section 2*a* shown in FIGS. 2(A) to 2(D) is integrally formed at the center of the support section 2*b*, which has a thin-wall disc like shape, and projects from the support section 2*b*. The hinge section 6 is located between a part of the support section 2*b* and the casing body 1*a*. Alternatively, as shown in FIG. 2(E), the button section 2*a* may be integrally formed at a center of a support section having a spiral spring like shape, and projects from it. In this case, the hinge section 6 is positioned between the proximal end of the outer periphery of the spiral spring like support section 2*b* and the casing body 1*a*. Alternatively, as shown in FIG. 3, the button section 2*a* may be supported at the center of a central circular hole 2*c* in the support section 2*b* of a magnifying glass like shape by means of a bridge 2*d*, with the hinge section 6 positioned between a handle of the support section 2*b* and the casing body 1*a*.

In the second embodiment, as described above, the three components (casing body 1*a*, cover 1*b* and push button 2) are concurrently formed by monolithic molding and are connected together through the hinge sections 6. The mold structure used for this purpose may be in the form of a single mold consisting of a mold section for forming the casing body 1*a*, a mold section for forming the cover 1*b* and a mold section for forming the push button 2, which communicate with each other in turn through communication sections, between adjacent edges of the two mold sections. The thin-wall hinge sections 6 are formed by the communication sections.

Figure 4:
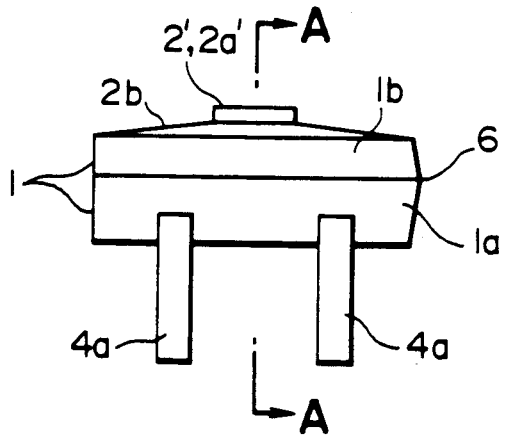
FIG. 4(A) is a view similar to FIG. 1(A) showing a third embodiment.
FIG. 4(B) is a sectional view taken along line A—A of FIG. 4(A)
Figure 4:
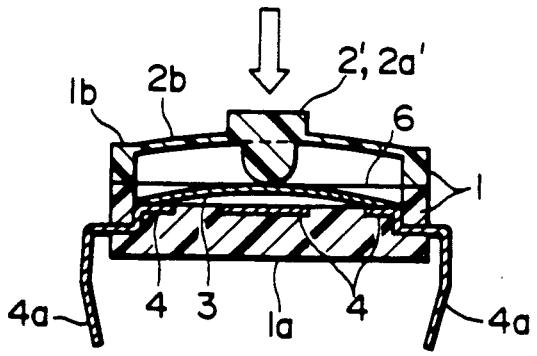

A third embodiment is shown in FIGS. 4(A) and 4(B). This switch includes a casing body 1*a* and a cover 1*b* whose central portion has a push button section 2' vertically movable by pushing, which are concurrently formed from a plastic material by monolithic molding and which are interconnected through a hinge section 6. A diaphragm type movable contact 3 is located in the casing body 1*a* and the cover 1*b* with its central push button section 2' is pivoted towards the casing body 1*a* about the hinge section 6. Cover 1*b* is fixed on the casing body 1*a* using some suitable means to provide the finished push button switch.

The push button section 2′ is sufficiently flexible and/or elastic to be vertically movable by a predetermined distance by suitable pushing. In the illustrated embodiment, the predetermined distance is set to be sufficient to actuate the diaphragm type movable contact 3 properly.

Figure 5A:
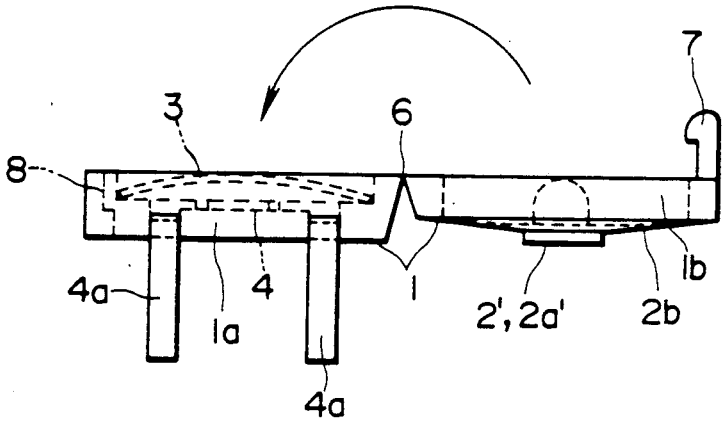
FIG. 5(A) is a front elevational view of the push button switch of FIG. 4(A) as molded, with the cover open.
Figure 5B:
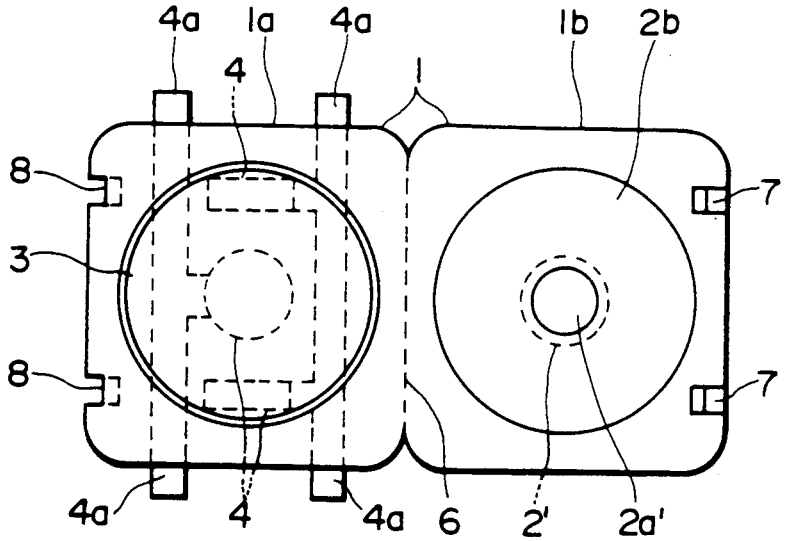
FIG. 5(B) is a plan view of the push button switch shown in FIG. 5(A)
Figure 7A:
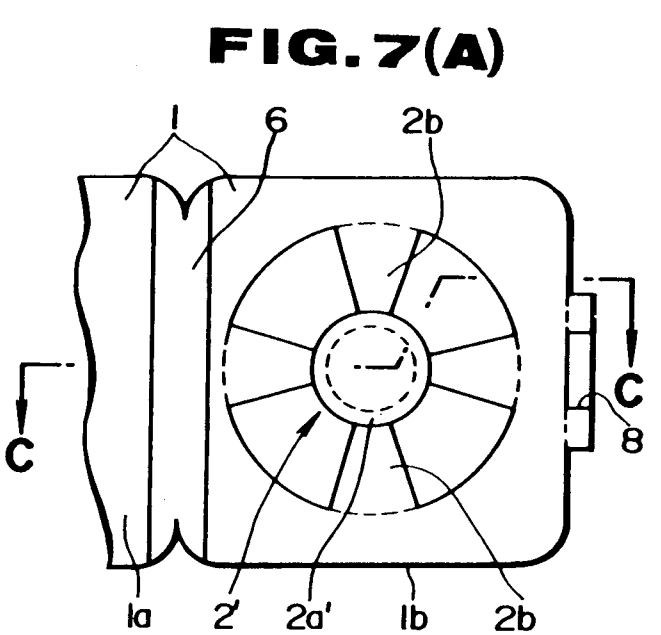
FIG. 7(A) is a bottom view showing another modification of the push button switch shown in FIG. 4(A) in which the cover is provided with the push button.
Figure 7B:
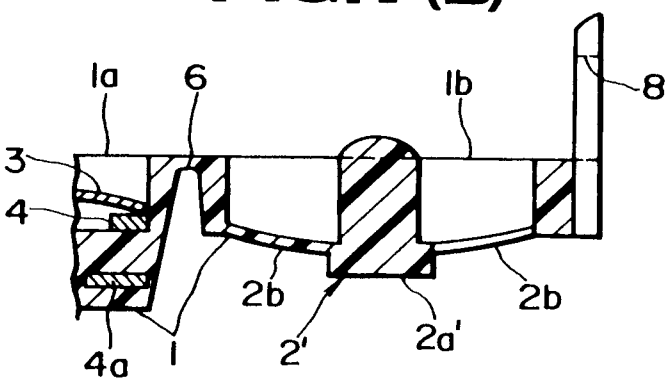
FIG. 7(B) is a sectional view taken along line C—C of FIG. 7(A)
Figure 6A:
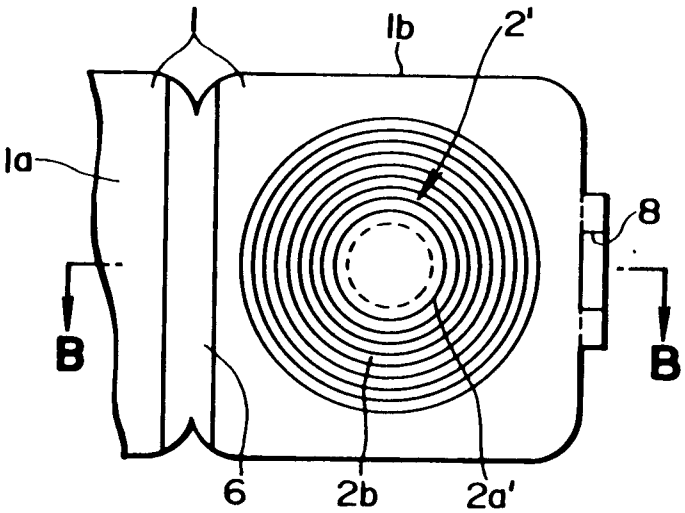
FIG. 6(A) is a bottom view showing a modification of the switch shown in FIG. 4(A) in which the cover is provided with the push button.
Figure 6B:
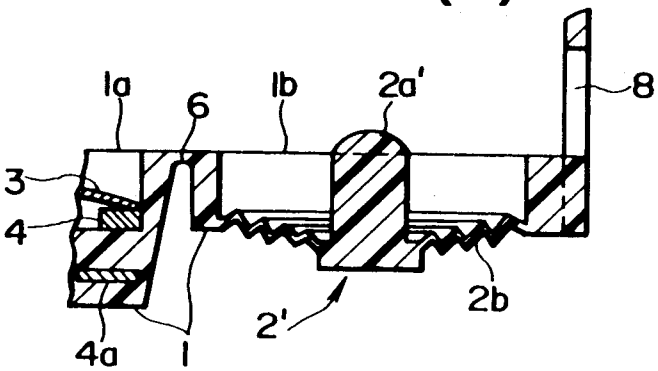
FIG. 6(B) is a sectional view taken along line B—B of FIG. 6(A)
Figure 8:
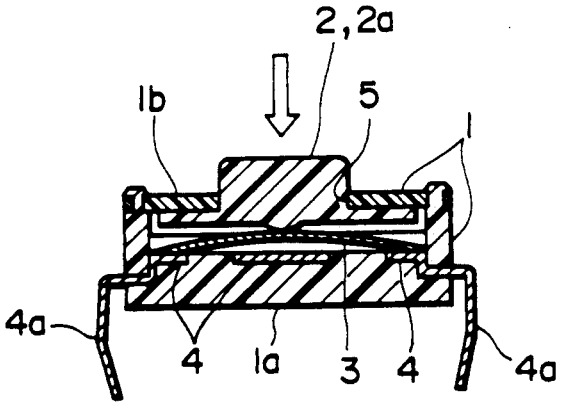
FIG. 8 PRIOR ART
FIG. 8 is a sectional view showing a conventional push button switch.

The push button section 2′ is used in place of the push button 2 provided separately in the embodiments described above but exhibits substantially the same function as the push button 2. Rather than be as shown in the embodiment in FIG. 4(A) and 4(B), 5(A) and 5(B), the push button section 2′ may be formed alternatively as shown in FIGS. 6(A) and 6(B) or 7(A) and 7(B). In FIGS. 5(A) and 5(B), the push button section 2′ is formed by forming a button like projection 2*a*′ at the center of the cover 1*b*. The cover 1*b* has a flat box like configuration which is substantially square in plan. The projection 2*a*′ has a thin-walled periphery 2*b* to provide the push button section with flexibility and/or elasticity. In FIGS. 6(A) and 6(B), the periphery 2*b* has a corrugated or accordion-like configuration. Alternatively, it may have a bridge-like configuration as shown in FIGS. 7(A) and 7(B) in which the projection 2*a*′ is attached to cover 1*b* through a series (in this case four) of webs. In all cases, the push button section 2′ can be moved satisfactorily by suitable pressing.

In the third embodiment, as described above, the casing body 1*a* and cover 1*b* with its push button section 2′ are simultaneously formed by monolithic molding and are interconnected through the hinge section 6. The mold structure used for this purpose may be in the form of a single mold consisting of a mold section for forming the casing body 1*a* and a mold section forming the cover 1*b* and push button section 2′, which communicate with each other through a communication section between edges of the two mold sections. The thin-wall hinge section 6 is formed by the communication section.

The method of assembly of each of the above embodiments will now be described.

In the first embodiment of the present invention, the casing body 1*a* and cover 1*b* are integrally connected together through the hinge section 6. Thus, assembly is readily accomplished by pivoting the cover 1*b* about the hinge section 6 towards the casing body 1*a* after the separately formed diaphragm type movable contact 3 and push button 2 have been inserted into the casing body 1*a*. The projections 7 are then engaged in the recesses 8 to form the casing 1, and the push button switch is instantaneously formed.

In the second embodiment of the present invention, the cover 1*b*, casing body la and push button 2 are integrally connected to each other in turn through the hinge sections 6. After the separately formed diaphragm type movable contact 3 is inserted into the casing body 1*a*, the push button is located in the casing body 1*a* by pivotal movement about its hinge section 6 and then the cover 1*b* is pivoted towards the casing body 1*a* about its hinge section 6. The projections 7 and the recesses 8 or apertures 8′ engage and the cover 1*b* is fixed to the casing body 1*a*, forming the push button switch.

In the third embodiment, the casing body 1*a* and the cover 1*b* which is provided with the push button section 2′, are integrally connected to each other through the hinge section 6. The separately formed diaphragm type movable contact 3 is located in the casing body 1*a* and the cover 1*b* is pivoted towards the casing body 1*a* about the hinge section 6. The projections 7 engage the recesses or apertures 8, so that the casing 1 may be formed, resulting in the push button switch being assembled.

In each of the first and second embodiments, the upper portion of the button section 2*a* of the push button 2 projects upwards and slightly outwardly from the cover 1*b* via the through-hole 5 of the cover 1*b*. Accordingly, when the push button 2 is pushed down, the bottom surface of the push button 2 forces the diaphragm type movable contact 3 downwards to depress it, so that the movable contact 3 may be contacted with the fixed contact 4, resulting in the switch being turned on.

In the third embodiment of the present invention, when the push button section 2′ of the cover 1*b* is pushed down, the projection 2*a*′ of the push button section 2′ forces the central portion of the diaphragm type movable contact 3 downwards to depress it, so that the switch may be turned on. When the push button 2 or push button section 2′ is released from pushing, the diaphragm returns to its original position due to its own elasticity, which causes the push button 2 or push button section 2′ to return to its original position to project from the cover 1*b*.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A push button switch comprising:
   - a casing including a casing body and a cover having an aperture formed therein;
   - a push button movably positioned in said aperture of said cover and made of a plastic material;
   - a diaphragm type movable metal contact and fixed contacts located in said casing; and
   - a plurality of terminals connected to said fixed contacts;
   - said casing body and cover being integrally connected to each other through a thin-wall hinge section by a concurrently formed casing body and cover from a plastic material by monolithic molding wherein said hinge section comprises adjacent edge portions of said casing body and said cover which are interconnected along a substantially entire length portion of said adjacent edge portions;
   - said cover being pivotally movable about said hinge section and fixed to said body at an edge opposite said hinge section.

2. A push button switch as defined in claim 1, wherein said push button comprises a push button section on said cover, said casing body and said cover being integrally connected through said hinge section.

3. A push button switch as defined in claim 2, wherein said push button section is formed at a central portion of said cover and is movable vertically by a predetermined distance when pushed.

4. A push button switch as defined in claim 2, wherein said push button section comprises a button-like projection formed on a central portion of said cover and a periphery surrounding said projection, said periphery consisting of one of a thin-wall shape, an accordion-like shape and a bridge-like shape, whereby said push button section is vertically moved by a predetermined distance when it is pushed.

5. A push button switch as defined in claim 2, wherein said casing body is formed in one mold section and said cover provided with said push button section is formed in another mold section;

said two mold sections communicating with each other through adjacent edges of said two mold sections.

* * * * *